US009383132B2

(12) United States Patent
Boarman et al.

(10) Patent No.: US 9,383,132 B2
(45) Date of Patent: Jul. 5, 2016

(54) REFRIGERATOR PROVIDING AIR FLOW TO DOOR

(71) Applicant: Whirlpool Corporation, Benton Harbor, MI (US)

(72) Inventors: Patrick J. Boarman, Evansville, IN (US); Mark E. Thomas, Corydon, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 487 days.

(21) Appl. No.: 13/691,887

(22) Filed: Dec. 3, 2012

(65) Prior Publication Data

US 2014/0150473 A1 Jun. 5, 2014

(51) Int. Cl.

| | |
|---|---|
| ***F25D 23/02*** | (2006.01) |
| ***F25C 1/00*** | (2006.01) |
| ***F25D 17/06*** | (2006.01) |
| ***F25C 1/04*** | (2006.01) |
| *F25C 5/18* | (2006.01) |

(52) U.S. Cl.

CPC ..... *F25D 17/065* (2013.01); *F25C 1/04* (2013.01); *F25C 5/182* (2013.01); *F25C 2400/10* (2013.01); *F25D 2317/061* (2013.01); *F25D 2317/062* (2013.01); *F25D 2323/021* (2013.01)

(58) Field of Classification Search

CPC ..... F25D 23/804; F25D 2317/062; F25D 2317/0663; F25D 2317/0653; F25D 2323/021; F25C 5/182

USPC ..... 62/377

See application file for complete search history.

(56) References Cited

U.S. PATENT DOCUMENTS 4,926,654 A * 5/1990 Johnson ..... 62/229
5,375,428 A * 12/1994 LeClear et al. ..... 62/187

(Continued)

FOREIGN PATENT DOCUMENTS

DE 102010001465 A1 8/2011
DE 102010042080 A1 4/2012

(Continued)

OTHER PUBLICATIONS http://www.thefreedictionary.com/mullion, entry 2, The Free Dictionary by Farlex, date accessed Feb. 2, 2015.*
EP Search Opinion, EP2738483, Dated Feb. 2, 2015.
EP Search Opinion, EP2738484, Dated Feb. 23, 2015.
EP Search Opinion, EP2738485, Dated Feb. 2, 2015.

(Continued)

*Primary Examiner* — Cassey D Bauer

(57) ABSTRACT

A refrigerator includes a refrigerator cabinet, a fresh food compartment disposed within the refrigerator cabinet, a freezer compartment disposed within the refrigerator cabinet below the fresh food compartment, and first and second French doors operatively connected to the refrigerator cabinet to provide access to the fresh food compartment. There is also a mullion between the fresh food compartment and the freezer compartment, an air inlet and an air outlet proximate a bottom of the first French door, and an air outlet and an air inlet on a front face of the mullion. When the first French door is in a closed position, the air inlet proximate the bottom of the first French door aligns with the air outlet on the front face of the mullion and the air outlet proximate the bottom of the first French door aligns with the air inlet on the front face of the mullion.

18 Claims, 6 Drawing Sheets

(56) References Cited

U.S. PATENT DOCUMENTS

| | | | | |
|---|---|---|---|---|
| 5,385,032 | A | 1/1995 | Martin et al. | |
| 5,816,060 | A | 10/1998 | Brownell et al. | |
| 6,735,959 | B1 | 5/2004 | Najewicz | |
| 6,837,067 | B2 | 1/2005 | Lee | |
| 6,880,949 | B2 * | 4/2005 | Miozza et al. | 362/92 |
| 7,188,479 | B2 * | 3/2007 | Anselmino et al. | 62/66 |
| 2006/0168983 | A1 | 8/2006 | Tatsui | |
| 2006/0260325 | A1 | 11/2006 | Lin | |
| 2006/0260350 | A1 | 11/2006 | Van Meter | |
| 2010/0126185 | A1 | 5/2010 | Cho | |
| 2010/0257877 | A1 * | 10/2010 | Yun et al. | 62/89 |
| 2011/0100046 | A1 | 5/2011 | Choi et al. | |
| 2012/0167596 | A1 | 7/2012 | Krause | |

FOREIGN PATENT DOCUMENTS

| | | | |
|---|---|---|---|
| EP | 1821051 | A1 | 8/2007 |
| EP | 2444761 | A2 | 4/2012 |

OTHER PUBLICATIONS

EP Search Opinion, EP2738496, Dated Feb. 2, 2015.
EP Search Opinion, EP2738497, Dated Feb. 2, 2015.
DE102010042080 Machine Translation from Espacenet.
DE102010001465 Machine Translation from Espacenet.
Vian, J. et. al, "Development of a Thermoelectric Ice Maker of Fingers Incorporated into a Static Domestic Refrigerator", 5th European Conference on Thermoelectrics, Sep. 10, 2007, pp. 1-6.

* cited by examiner

REFRIGERATOR PROVIDING AIR FLOW TO DOOR

FIELD OF THE INVENTION

The present invention relates to refrigerators. More particularly, but not exclusively, the present invention relates to a refrigerator in which air flow is provided to the door.

BACKGROUND OF THE INVENTION

In certain types of refrigerators it may be desirable to provide cold air to the door. One such example of a refrigerator is a refrigerator where an ice maker is on the door such as a French door with bottom mounted freezer configuration. Various attempts have been made to bring cold air to the door through a sidewall or a top wall of refrigerator. Yet problems remain including poor aesthetics and condensation issues whenever thin walled sections are used due to the routing of cold air to the door. What is needed is a refrigerator with improved air flow to the door.

SUMMARY OF THE INVENTION

Therefore, it is a primary object, feature, or advantage of the present invention to improve over the state of the art.

Another object, feature, or advantage of the present invention is to provide for improved air flow to a door of a refrigerator.

A still further object, feature, or advantage of the present invention is to provide air flow to a door of a refrigerator in a manner that is aesthetically pleasing.

Another object, feature, or advantage of the present invention is to provide air flow to a door of a refrigerator in a manner that reduces or eliminations condensation issues.

One or more of these and/or other objects, features, or advantages of the present invention will become apparent from the specification and claims that follow. No single embodiment need meet or provide each and every object, feature, or advantage. Different embodiments may have different objects, features, or advantages. The present invention is not to be limited by or to these objects, features, or advantages.

According to one aspect, a refrigerator is provided which includes a refrigerator cabinet, a fresh food compartment disposed within the refrigerator cabinet, a freezer compartment disposed within the refrigerator cabinet below the fresh food compartment, and first and second French doors operatively connected to the refrigerator cabinet to provide access to the fresh food compartment. There is also a mullion between the fresh food compartment and the freezer compartment, an air inlet and an air outlet proximate a bottom of the first French door, and an air outlet and an air inlet on a front face of the mullion. When the first French door is in a closed position, the air inlet proximate the bottom of the first French door aligns with the air outlet on the front face of the mullion and the air outlet proximate the bottom of the first French door aligns with the air inlet on the front face of the mullion. An ice maker may be on the first French door and an ice storage bucket may also be on the first French door.

According to another aspect, a refrigerator is provided which includes a refrigerator cabinet, a fresh food compartment disposed within the refrigerator cabinet, a freezer compartment disposed within the refrigerator cabinet below the fresh food compartment, and first and second French doors operatively connected to the refrigerator cabinet to provide access to the fresh food compartment. The refrigerator further includes an ice maker on the first French door, an ice storage bucket on the first French door and below the ice maker, a mullion between the fresh food compartment and the freezer compartment, a first air opening proximate a bottom of the first French door, and a second air opening in a front face of mullion. When the first French door is in a closed position the first air opening is aligned with the second air opening to allow for air flow therebetween. The refrigerator may further include a third air opening proximate the bottom of the first French door and a fourth air opening in the front face of the mullion. When the first French door is in the closed position the third air opening may be aligned with the fourth air opening to allow for air flow therebetween.

According to another aspect, a method of operating a refrigerator is provided. The method includes providing a refrigerator. The refrigerator may include a refrigerator cabinet, a fresh food compartment disposed within the refrigerator cabinet, a freezer compartment disposed within the refrigerator cabinet, first and second French doors operatively connected to the refrigerator cabinet to provide access to the fresh food compartment, a mullion between the fresh food compartment and the freezer compartment, an ice maker on the first French door, and (h) an ice storage bucket on the first French door, and routing air through one or more openings in the mullion to one or more openings in the French doors when the first French door is in a closed position in order to provide cool air. The method may further include routing air through one or more openings in the French doors to one or more openings in the mullion when the first French door is in a closed position. The method may further include routing the air from the one or more openings in the mullion to the ice maker and/or routing the air from the one or more openings in the mullion to the ice storage bucket.

DETAILED DESCRIPTION OF THE PREFERRED EMBODIMENT

Figure 1:
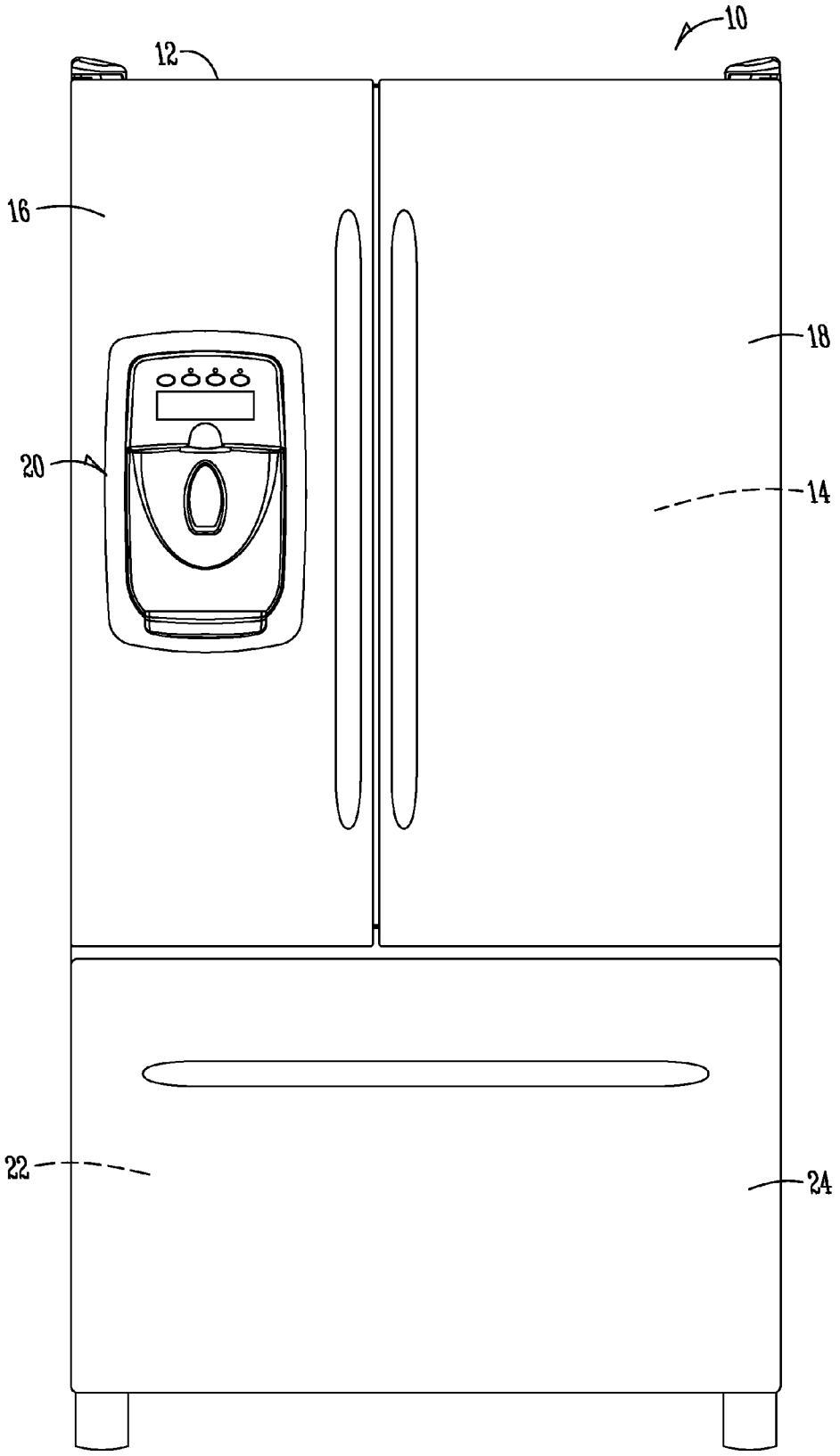
FIG. 1 illustrates one embodiment of a refrigerator of the present invention.

FIG. 1 illustrates one embodiment of a refrigerator of the present invention. In FIG. 1 a refrigerator 10 has a bottom mount freezer with French doors. The refrigerator 10 has a refrigerator cabinet 12. One or more compartments are disposed within the refrigerator cabinet 12. As shown in FIG. 1, a fresh food compartment 14 is shown with French doors 16, 18 providing access to the fresh food compartment 14. Mounted on the door 16 is a water and ice dispenser 20. Below the fresh food compartment 14 is a freezer compartment 22 which may be accessed by pulling drawer 24 outwardly.

Figure 2:
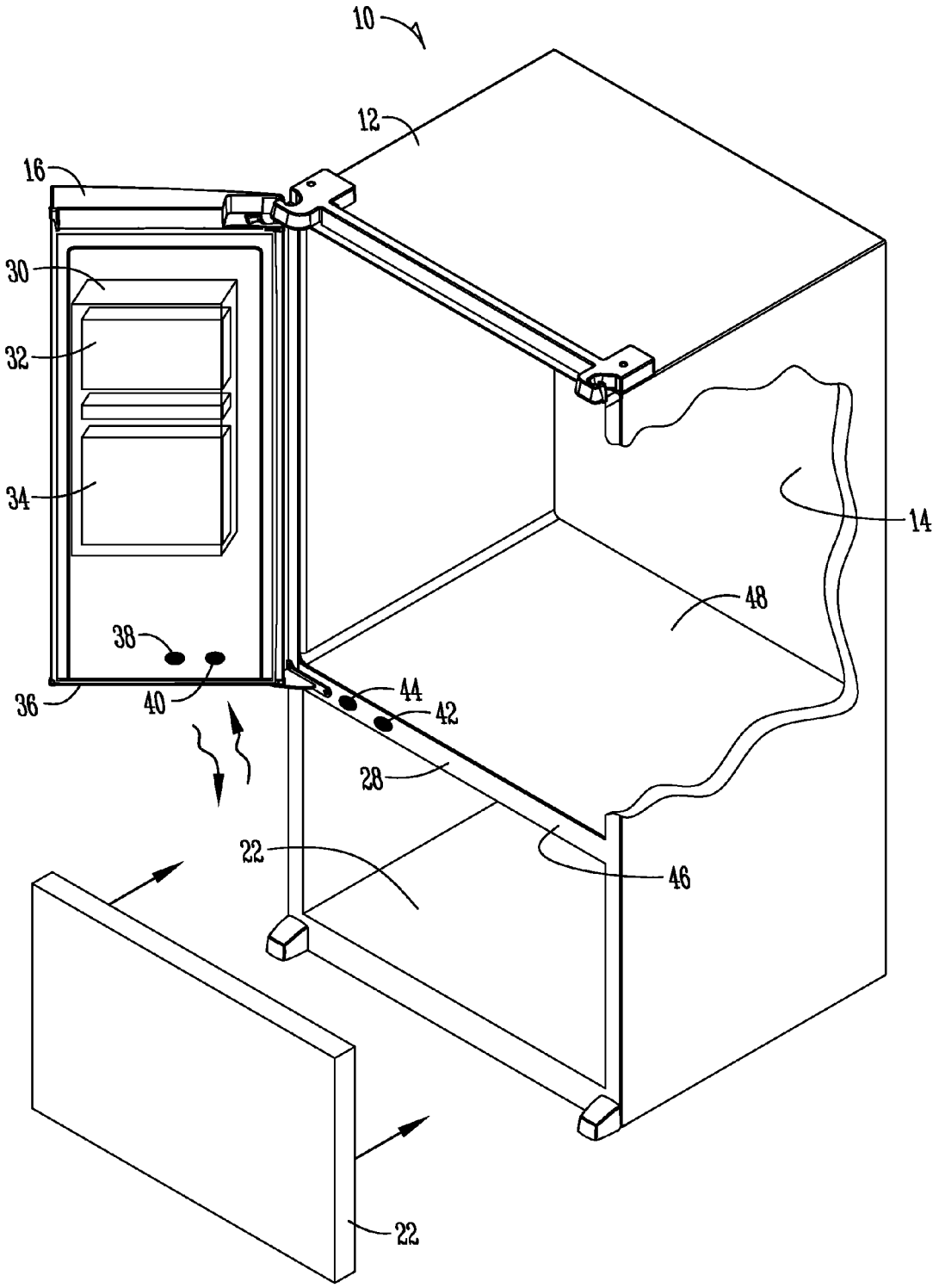
FIG. 2 illustrates one example of an ice maker with a heater.

FIG. 2 illustrates the refrigerator 10 of FIG. 1 with French doors 16, 18 in an open position and with the drawer 24 providing access to the freezer compartment 22. Mounted on the French door 16 is an ice making compartment 30 in which an ice maker 32 and an ice storage bucket 34 are disposed. Note that the ice making compartment 30 is positioned within the fresh food compartment 14. The ice storage bucket 34 may be positioned below the ice maker 32. Preferably, the ice maker 24 is configured to make clear ice or wet ice which is ice which is generally transparent and generally appears not to have air or other impurities. Such ice is generally made at a temperature near freezing.

The fresh food compartment 14 is separated from the freezer compartment 22 by a mullion 28. As shown the mullion 28 extends in a horizontal plane within the refrigerator cabinet 12 to separate the freezer compartment 22 and the fresh food compartment 14. The mullion 28 is constructed in a manner that allows it to provide physical separation and also to assist in maintaining separate temperatures in the fresh food compartment 14 and the freezer compartment 22.

Near the bottom 36 of the French door 16 there is an air inlet 40 and an air outlet 38. On a front face 46 of the mullion 28, there is an air outlet 44 and an air inlet 42. When the French door 16 is in a closed position, the air outlet 44 is generally aligned with and provides air to the air inlet 40 of the French door 16 and the air outlet 38 of the French door 16 is generally aligned with and provides air to the air inlet 42 on the mullion 28. Thus, in this manner, air may be circulated through the French door 16. Where air being circulated from the mullion 28 to the French door 16 is cold air, the source for the cold air may be the freezer compartment 22. Note that the placement of air openings in the mullion and the bottom of the door provide for air flow to and from the door in a manner that is aesthetically pleasing relative to alternatives and does not require extra thin walled sections in the fresh food compartment 14 in order to route the air.

Figure 3:
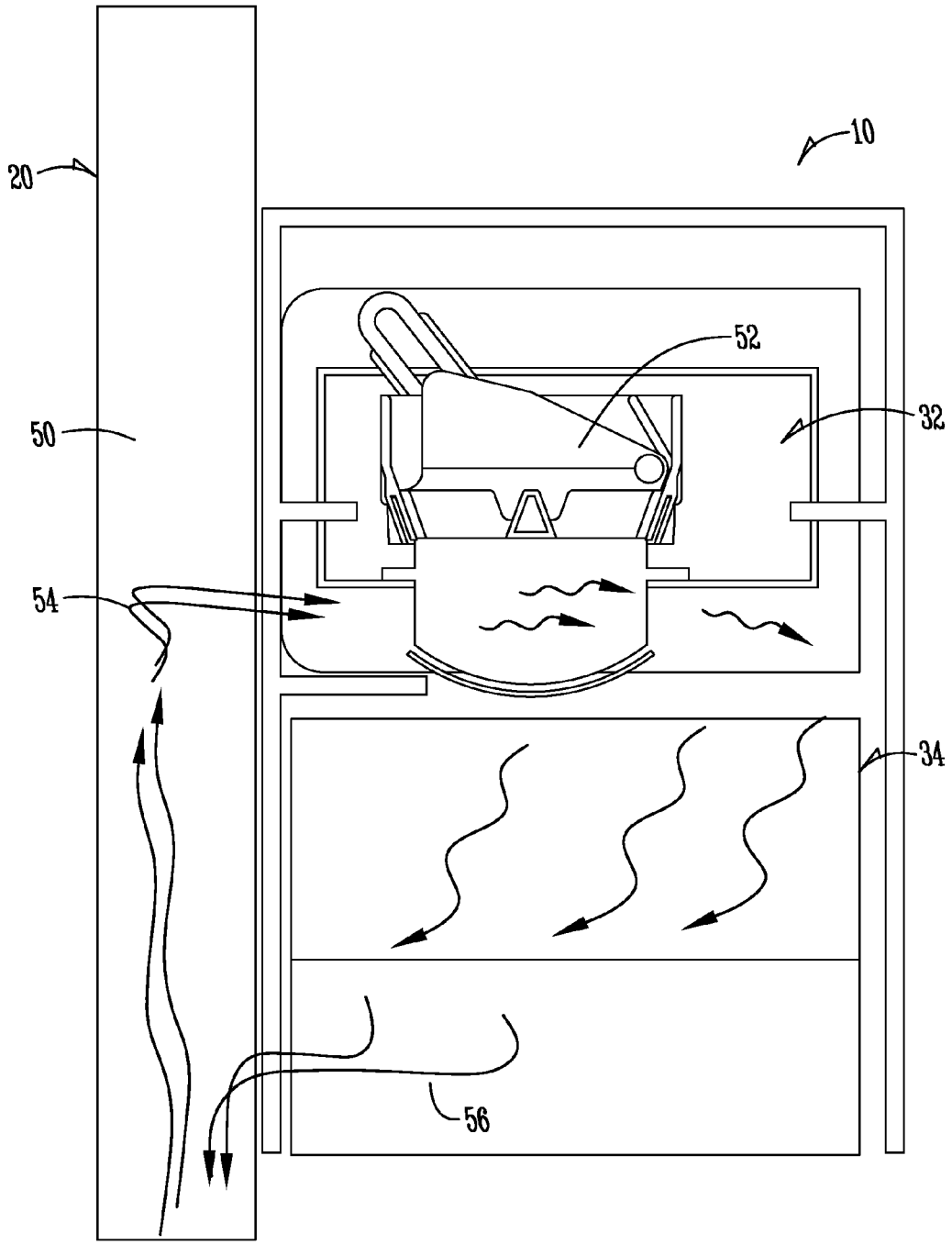
FIG. 3 illustrates a control system for operating a heater.

FIG. 3 illustrates one manner in which cold air may be circulated through the French door 16. Air is circulated up from one or more openings in the French door (not shown in FIG. 3) through a first air passageway 54 of an inner cavity 50 to the ice maker 32. The cold air may be directed to a location under an ice mold 52 of the ice maker 30 to assist in the ice making process. After leaving the ice maker 32, the cold air may travel through an ice storage bucket 34 and circulated back to the inner cavity 50 of the door 16 through a second air passageway 56 and eventually out one or more openings (not shown in FIG. 3) in the French door 16. Thus, one use of air flow to and from the mullion is to circulate cold air to the ice maker 32 and the ice storage bucket 34.

Figure 4:
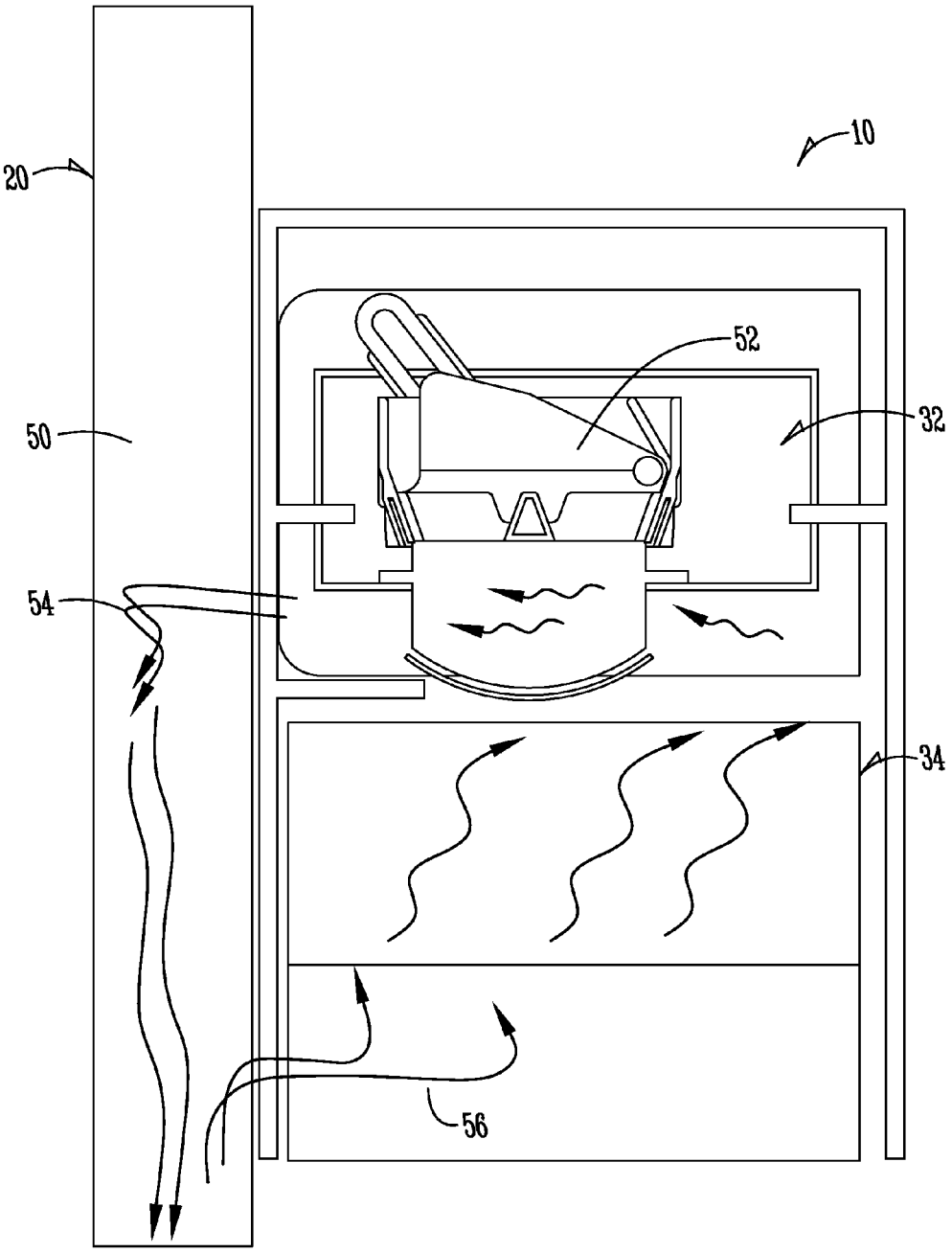
FIG. 4 is another view of an ice maker and ice storage bin within in a refrigerator.

FIG. 4 illustrates another example of the manner in which cold air may be circulated through the French door 16. In FIG. 4, air is circulated up from one or more openings in the French door (not shown in FIG. 4) through the second air passageway 56 to an inner cavity 50 to the ice storage bucket 34. From the ice storage bucket 34, the cold air is directed further upward towards the ice mold 52 of the ice maker 32. After leaving the ice maker 32, the air may travel through the first air passageway 54 of the inner cavity 50 of the door 16 and eventually out one or more openings (not shown in FIG. 4) in the French door 16. Thus, one use of air flow to and from the mullion is to circulate cold air to the ice storage bucket 34 and the ice maker 32.

Figure 5:
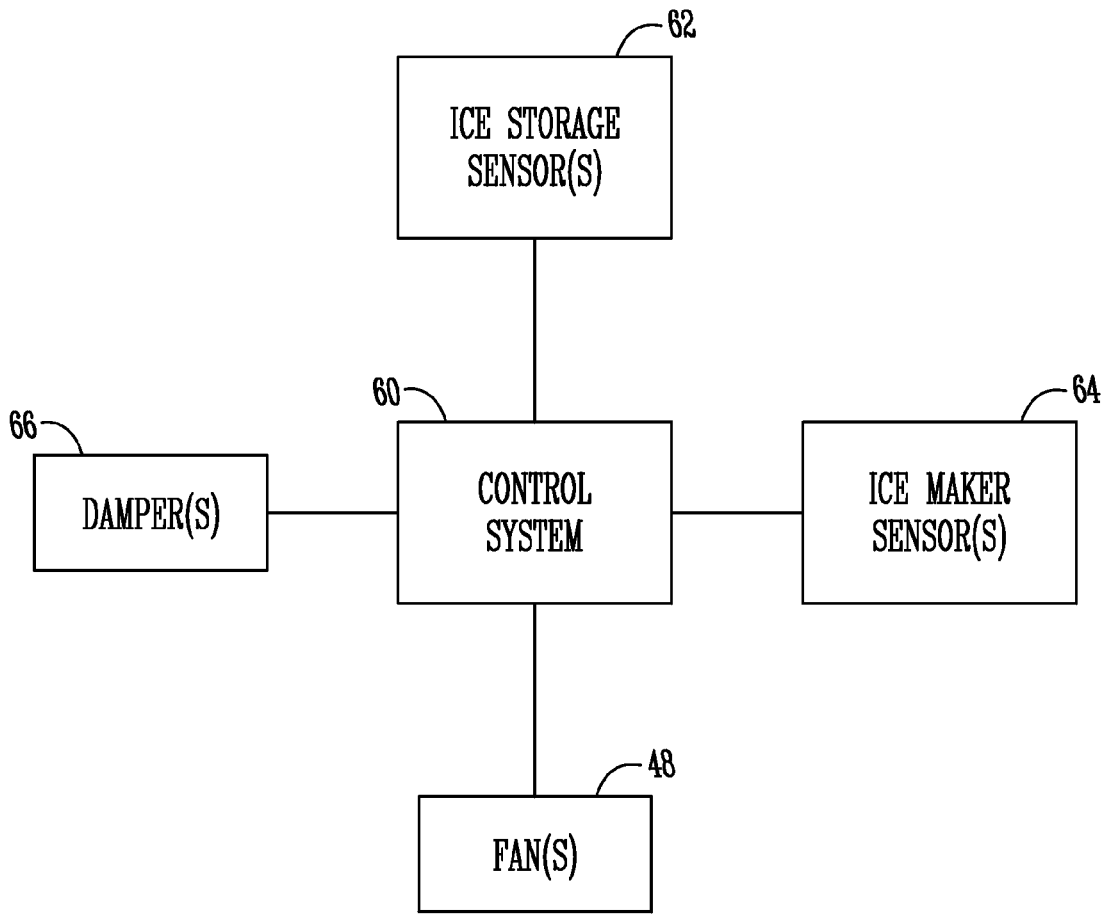
FIG. 5 illustrates one example of a method.

FIG. 5 illustrates one example of a control system 60 used for controlling the routing of air. The control system 60 may be operatively connected to one or more fans 48 which may be positioned within the mullion and one or more dampers 66 for controlling air flow. The control system 60 may be further connected to one or more ice storage sensors 62 and one or more ice maker sensors 64. The control system 60 determines when air should be routed to or from the French door which may be determined using the one or more ice storage sensors 62 and the one or more ice maker sensors 64. Alternatively, or in addition to using such sensors which may include, for example thermistors or other type of temperature sensors, the control system 60 may use a schedule or other algorithms to determine when to operate a fan 48. Although it is preferred that one or more fans 48 be positioned in the mullion fan, the one or more fans 48 need not be placed in the mullion but may otherwise be positioned such as in the door or elsewhere within the refrigerator cabinet provided it assists in circulating air to or from the door. Air may be returned to an evaporator, the freezer compartment, or other specialty compartment which provides for a different temperature or different environment.

Figure 6:
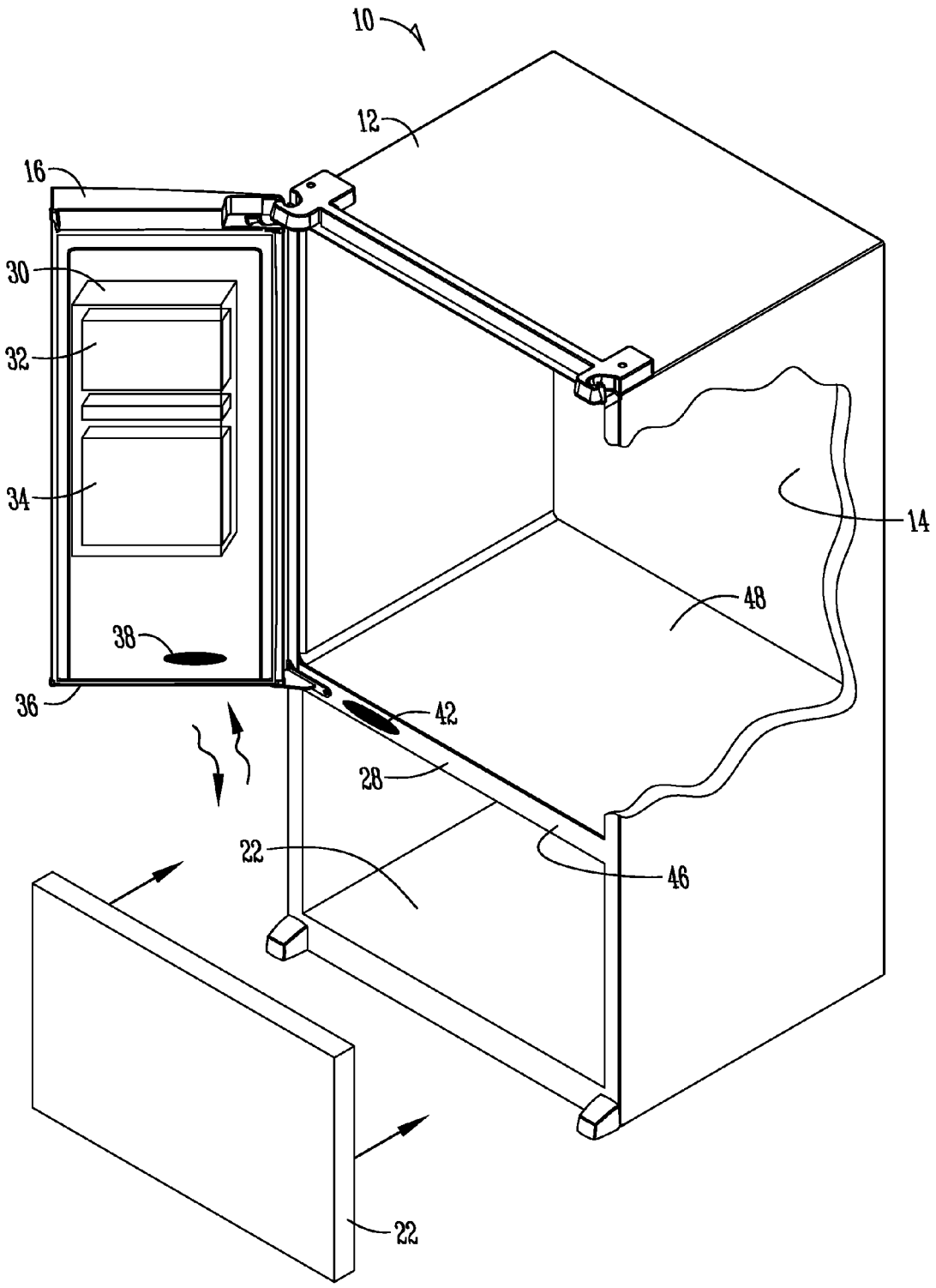
FIG. 6 illustrates an ice maker, ice storage bucket, and a fluid warming loop.

FIG. 6 illustrates another example of a refrigerator where instead of mating air inlets and outlets, a single pathway for air is provided between the mullion 28 and the door 16. Using one or more fans and/or dampers, air may be circulated either way through the pathway. It is also contemplated that instead of a single opening 42 in the mullion and a single opening 38 in the door, multiple openings may be used such as previously shown, however air would be circulated in a single direction at a time.

Therefore, a refrigerator which provides for air flow to a door has been described. The present invention contemplates numerous variations including the number and placement of air openings in the door, the number and placement of air openings in the mullion, the pathways of air through the door, and other options, variations, and alternatives. In general, the present invention is only intended to be limited by the scope of the following claims.

What is claimed is:

1. A refrigerator comprising:

a refrigerator cabinet;

a fresh food compartment disposed within the refrigerator cabinet, the fresh food compartment having a back wall and two opposite side walls;

a freezer compartment disposed within the refrigerator cabinet below the fresh food compartment;

first and second French doors operatively connected to the refrigerator cabinet to provide access to the fresh food compartment;

an ice maker and an ice storage bucket on the first French door;

a mullion between the fresh food compartment and the freezer compartment;

an air inlet and an air outlet proximate a bottom of the first French door;

an air outlet and an air inlet on a front face of the mullion;

a first air flow path comprising, in sequence, the air inlet proximate the bottom of the first French door, the ice maker, the ice storage bucket, and the air outlet proximate the bottom of the first French door;

a second air flow path comprising, in sequence, the air inlet proximate the bottom of the first French door, the ice storage bucket, the ice maker, and the air outlet on the bottom of the first French door, a control system adapted to selectively control air flow through the first air flow path in a first mode and air flow through the second air flow path in a second mode;

wherein when the first French door is in a closed position, the air inlet proximate the bottom of the first French door aligns with the air outlet on the front face of the mullion and the air outlet proximate the bottom of the first French door aligns with the air inlet on the front face of the mullion.

2. The refrigerator of claim 1 wherein the ice storage bucket is positioned below the ice maker.

3. The refrigerator of claim 1 wherein the control system controls the first air flow path and the second air flow path based, at least in part, on one or more ice maker sensors and one or more ice storage sensors.

4. The refrigerator of claim 1 further comprising one or more fans positioned within the mullion.

5. The method of claim 4 wherein at least one of the one or more fans is positioned within the first French door.

6. The refrigerator of claim 1 wherein the air inlet proximate the bottom of the French door, the air outlet on the front face of the mullion, the air outlet proximate the bottom of the French door and the air inlet on the front face of the mullion have elliptical cross sections.

7. The refrigerator of claim 1 wherein a flow of air remains inline with the mullion while passing through the mullion.

8. A refrigerator comprising:

a refrigerator cabinet;

a fresh food compartment disposed within the refrigerator cabinet, the fresh food compartment having a back wall and two opposite side walls;

a freezer compartment disposed within the refrigerator cabinet below the fresh food compartment;

first and second French doors operatively connected to the refrigerator cabinet to provide access to the fresh food compartment;

an ice maker on the first French door;

an ice storage bucket on the first French door and below the ice maker;

a mullion between the fresh food compartment and the freezer compartment;

a first air opening proximate a bottom of the first French door;

a second air opening in a front face of mullion;

a control system adapted to circulate air between the first air opening and the second air opening, and selectively circulate the air from the ice maker to the ice storage bucket in a first mode, and from the ice storage bucket to the ice maker in a second mode, wherein when the first French door is in a closed position the first air opening is aligned with the second air opening to allow for air flow therebetween.

9. The refrigerator of claim 8 further comprising a third air opening proximate the bottom of the first French door and a fourth air opening in the front face of the mullion; and wherein when the first French door is in the closed position the third air opening is aligned with the fourth air opening to allow for air flow therebetween.

10. The refrigerator of claim 9 further comprising a first air passageway in the first French door, the first air passageway between the first air opening and the ice maker.

11. The refrigerator of claim 10 further comprising a second air passageway in the first French door, the second air passageway between the third air opening and the ice storage bucket.

12. The refrigerator of claim 11 wherein the control system selectively circulates air from the second air opening, to first air opening, to the ice maker, and to the ice storage bucket in sequence.

13. The refrigerator of claim 11 wherein the control system selectively circulates air from the second air opening, to the first air opening, to the ice storage bucket, and the ice maker in sequence.

14. The refrigerator of claim 8 further comprising a fan disposed within the mullion to assist in controlling air flow.

15. The refrigerator of claim 8 further comprising a fan disposed within the first French door to assist in controlling air flow.

16. The refrigerator of claim 1 wherein the mullion is of unitary construction.

17. A method of operating a refrigerator, comprising:

providing a refrigerator comprising (a) a refrigerator cabinet, (b) a fresh food compartment disposed within the refrigerator cabinet, (c) a freezer compartment disposed within the refrigerator cabinet, (d) first and second French doors operatively connected to the refrigerator cabinet to provide access to the fresh food compartment, one of the first and second French doors having only one opening for routing air therethrough (f) a mullion between the fresh food compartment and the freezer compartment, the mullion having only one opening on a front face thereof for routing air therethrough (g) an ice maker on the first French door, (h) an ice storage bucket on the first French door, and (i) wherein the mullion has a unitary top surface extending from a back wall of the fresh food compartment to at least a portion of a front face of the mullion between an air outlet and an air inlet on the front face of the mullion; and routing air through the one opening in the front face of the mullion, to the one opening, and to the ice maker and the ice storage bucket.

18. The method of claim 17 further comprising routing air through one or more openings in the French doors to one or more openings in the mullion when the first French door is in a closed position.

* * * * *